US009177779B1

(12) United States Patent
Brockett et al.

(10) Patent No.: US 9,177,779 B1
(45) Date of Patent: Nov. 3, 2015

(54) LOW PROFILE ELECTRODELESS LAMPS WITH AN EXTERNALLY-GROUNDED PROBE

(71) Applicant: Topanga Technologies, Inc., Canoga Park, CA (US)

(72) Inventors: Timothy J. Brockett, Oakland, CA (US); Mehran Matloubian, Encino, CA (US)

(73) Assignee: Topanga USA, Inc., Canoga Park, CA (US)

( * ) Notice: Subject to any disclaimer, the term of this patent is extended or adjusted under 35 U.S.C. 154(b) by 369 days.

(21) Appl. No.: 13/886,500

(22) Filed: May 3, 2013

Related U.S. Application Data

(60) Provisional application No. 61/642,702, filed on May 4, 2012.

(51) Int. Cl.
*H01J 65/04* (2006.01)

(52) U.S. Cl.
CPC ..... *H01J 65/042* (2013.01)

(58) Field of Classification Search
CPC ..... H01J 65/042–65/048
See application file for complete search history.

(56) References Cited

U.S. PATENT DOCUMENTS

| | | | |
|---|---|---|---|
| 3,593,056 | A | 7/1971 | Degawa et al. |
| 3,679,928 | A | 7/1972 | Johnson |
| 3,943,403 | A | 3/1976 | Haugsjaa et al. |
| 3,943,404 | A | 3/1976 | McNeill et al. |
| 4,001,631 | A | 1/1977 | McNeill et al. |
| 4,001,632 | A | 1/1977 | Haugsjaa et al. |
| 4,002,944 | A | 1/1977 | McNeill et al. |
| 4,065,701 | A | 12/1977 | Haugsjaa et al. |
| 4,185,228 | A | 1/1980 | Regan |
| 4,498,029 | A | 2/1985 | Yoshizawa et al. |
| 4,597,035 | A | 6/1986 | Lettenmeyer |
| 4,774,637 | A | 9/1988 | Budde et al. |
| 4,975,655 | A | 12/1990 | Dawson et al. |
| 5,615,947 | A | 4/1997 | Shambo et al. |
| 5,637,963 | A | 6/1997 | Inoue et al. |
| 5,686,793 | A | 11/1997 | Turner et al. |
| 5,708,331 | A | 1/1998 | Vamvakas et al. |
| 5,757,130 | A | 5/1998 | Dolan et al. |
| 5,777,857 | A | 7/1998 | Degelmann |

(Continued)

FOREIGN PATENT DOCUMENTS

| | | | |
|---|---|---|---|
| JP | 2004-139852 | A | 5/2004 |

OTHER PUBLICATIONS

Bogaerts, et al., "Gas Discharge Plasmas and their Applications," Spectrochimica Acta, Part B 57, 2002, pp. 609-658.

(Continued)

*Primary Examiner* — Patrick O'Neill
(74) *Attorney, Agent, or Firm* — Kilpatrick Townsend and Stockton LLP

(57) ABSTRACT

An electrode-less plasma lamps, comprising generally of a bulb containing a gas-fill that is excited to produce light using radio-frequency (RF) energy. In specific embodiments, the use of grounded coupling-elements with integrated bulb assemblies simplifies manufacturability, improves resonant frequency control, and enables the use of solid, partially filled, and hollow lamp bodies. In an example, the lamp is configured with an rf feed that is substantially normal to a direction of the bulb and associated support member.

29 Claims, 4 Drawing Sheets

(56) References Cited

U.S. PATENT DOCUMENTS

| | | | | |
|---|---|---|---|---|
| 5,834,895 | A | 11/1998 | Dolan et al. | |
| 5,838,108 | A | 11/1998 | Frank et al. | |
| 5,841,233 | A | 11/1998 | Ury et al. | |
| 5,852,339 | A | 12/1998 | Hamilton et al. | |
| 5,886,480 | A | 3/1999 | Penzenstadler et al. | |
| 5,923,122 | A | 7/1999 | Frank et al. | |
| 6,137,237 | A | 10/2000 | MacLennan et al. | |
| 6,241,369 | B1 | 6/2001 | Mackiewicz | |
| 6,323,601 | B1 | 11/2001 | Klein et al. | |
| 6,348,669 | B1 | 2/2002 | Rudd Little et al. | |
| 6,372,186 | B1 | 4/2002 | Fencl et al. | |
| 6,476,557 | B1 | 11/2002 | Leng et al. | |
| 6,617,806 | B2 | 9/2003 | Kirkpatrick et al. | |
| 6,737,809 | B2 | 5/2004 | Espiau et al. | |
| 6,856,092 | B2 | 2/2005 | Pothoven et al. | |
| 6,922,021 | B2 | 7/2005 | Espiau et al. | |
| 7,119,641 | B2 | 10/2006 | Petrov et al. | |
| 7,291,785 | B2 | 11/2007 | Riester et al. | |
| 7,291,985 | B2 | 11/2007 | Espiau et al. | |
| 7,348,732 | B2 | 3/2008 | Espiau et al. | |
| 7,350,936 | B2 | 4/2008 | Ducharme et al. | |
| 7,358,678 | B2 | 4/2008 | Espiau et al. | |
| 7,362,054 | B2 | 4/2008 | Espiau et al. | |
| 7,362,055 | B2 | 4/2008 | Espiau et al. | |
| 7,362,056 | B2 | 4/2008 | Espiau et al. | |
| 7,372,209 | B2 | 5/2008 | Espiau et al. | |
| 7,391,158 | B2 | 6/2008 | Espiau et al. | |
| 7,719,195 | B2 | 5/2010 | DeVincentis et al. | |
| 7,830,092 | B2 | 11/2010 | Espiau et al. | |
| 8,282,435 | B2 | 10/2012 | Espiau | |
| 8,283,866 | B2 | 10/2012 | Espiau et al. | |
| 8,294,368 | B2 | 10/2012 | Espiau et al. | |
| 8,294,382 | B2 | 10/2012 | Devincentis et al. | |
| 8,384,300 | B2 * | 2/2013 | Matloubian et al. | 315/248 |
| 8,525,430 | B2 * | 9/2013 | Brockett et al. | 315/248 |
| 8,545,067 | B2 | 10/2013 | Espiau | |
| 8,629,616 | B2 | 1/2014 | Doughty | |
| 8,860,323 | B2 * | 10/2014 | DeVincentis | 315/248 |
| 2004/0056600 | A1 | 3/2004 | Lapatovich et al. | |
| 2005/0094940 | A1 | 5/2005 | Gao | |
| 2005/0095946 | A1 | 5/2005 | Fridrich | |
| 2005/0212456 | A1 | 9/2005 | Espiau et al. | |
| 2006/0250090 | A9 | 11/2006 | Guthrie et al. | |
| 2007/0109069 | A1 | 5/2007 | Espiau et al. | |
| 2007/0222352 | A1 | 9/2007 | DeVincentis et al. | |
| 2008/0054813 | A1 | 3/2008 | Espiau et al. | |
| 2008/0227320 | A1 | 9/2008 | Witham et al. | |
| 2010/0134008 | A1 | 6/2010 | Espiau et al. | |
| 2012/0014118 | A1 | 1/2012 | Espiau et al. | |
| 2012/0242223 | A1 * | 9/2012 | Espiau et al. | 315/34 |

OTHER PUBLICATIONS

International Search Report and Written Opinion of PCT Application No. PCT/US09/048174, mailed on Aug. 17, 2009, 17 pages total.

* cited by examiner

| Resonator Data | | Power: 330W Input | | Freq: ~434MHz | |
|---|---|---|---|---|---|
| Post | Lumens | CCT | X | Y | CRI |
| 4500K | | | | | |
| 7018 | 43648 | 4752 | 0.359 | 0.429 | 67.2 |
| 7032 | 44750 | 4685 | 0.362 | 0.431 | 67.5 |
| 7042 | 44800 | 4708 | 0.363 | 0.432 | 67.5 |
| 7034 | 45050 | 4725 | 0.362 | 0.431 | 67.4 |
| 7043 | 45100 | 4720 | 0.361 | 0.431 | 67.4 |
| 7048 | 45300 | 4676 | 0.362 | 0.431 | 67.5 |
| 7040 | 45500 | 4680 | 0.362 | 0.431 | 67.4 |
| 7037 | 45843 | 4726 | 0.36 | 0.43 | 67.48 |
| 7001 | 46023 | 4745 | 0.359 | 0.431 | 67.78 |
| 7031 | 46200 | 4710 | 0.363 | 0.432 | 67.6 |
| 7038 | 46350 | 4720 | 0.362 | 0.431 | 67.4 |
| Hi-CRI (4000K) | | | | | |
| 7055 | 32287 | 3735 | 0.393 | 0.384 | 83 |
| 7050 | 31641 | 3748 | 0.392 | 0.384 | 82.7 |
| 7029 | 30767 | 3748 | 0.392 | 0.382 | 82.5 |

Figure 4

LOW PROFILE ELECTRODELESS LAMPS WITH AN EXTERNALLY-GROUNDED PROBE

CROSS-REFERENCES TO RELATED APPLICATIONS

This application claims priority to U.S. Provisional Patent Application No. 61/642,702, filed May 4, 2012, commonly assigned and incorporated by reference herein for all purposes. This application is also related to U.S. patent application Ser. No. 12/484,933, filed Jun. 15, 2009, now U.S. Pat. No. 7,830,092, U.S. patent application Ser. No. 12/624,384, filed Nov. 23, 2009, now U.S. Pat. No. 8,179,047, U.S. patent application Ser. No. 12/720,603, filed Mar. 9, 2010, now U.S. Pat. No. 8,282,435, all of which are commonly assigned and incorporated by reference herein for all purposes.

BACKGROUND OF THE INVENTION

The present invention is directed to devices and methods for generating light with plasma lamps. More particularly, the present invention provides plasma lamps driven by a radio-frequency source without the use of electrodes inside a gas-filled vessel (bulb) and related methods. Merely by way of example, such plasma lamps can be applied to applications such as stadiums, security, parking lots, military and defense, streets, large and small buildings, vehicle headlamps, aircraft landing, bridges, warehouses, UV water treatment, agriculture, architectural lighting, stage lighting, medical illumination, microscopes, projectors and displays, any combination of these, and the like.

Plasma lamps provide extremely bright, broadband light, and are useful in applications such as general illumination, projection systems, and industrial processing. The typical plasma lamp manufactured today contains a mixture of gas and trace substances that is excited to form a plasma using a high current passed through closely-spaced electrodes. This arrangement, however, suffers from deterioration of the electrodes, and therefore a limited lifetime.

Electrodeless plasma lamps driven by microwave sources have been proposed in the prior art. Conventional configurations include a plasma fill encased either in a bulb or a sealed recess within a dielectric body forming a waveguide, with microwave energy being provided by a source such as a magnetron and introduced into the waveguide and heating the plasma resistively. Another example is provided by U.S. Pat. No. 6,737,809 B2 (Espiau et. al.), which shows a different arrangement that has limitations. Espiau et. al. shows a plasma-enclosing bulb and a dielectric cavity forming a part of a resonant microwave circuit with a microwave amplifier to provide excitation. Several drawbacks, however, exist with Espiau et al. The dielectric cavity is a spatially positioned around a periphery of the plasma-enclosing bulb in an integrated configuration, which physically blocks a substantial portion of the electromagnetic radiation in the form of light emitted from the bulb particularly in the visible region. Additionally, the integrated configuration is generally difficult to manufacture and limits the operation and reliability of the plasma-enclosing bulb. These and other limitations of conventional techniques may be further described throughout the present specification and more particularly below.

From above, it is seen that techniques for improved lighting are highly desired.

BRIEF SUMMARY OF THE INVENTION

According to the present invention, techniques directed to devices and methods for generating light with plasma lamps are provided. More particularly, the present invention provides plasma lamps driven by a radio-frequency source without the use of electrodes and related methods. Merely by way of example, such plasma lamps can be applied to applications such as stadiums, security, parking lots, military and defense, streets, large and small buildings, bridges, warehouses, agriculture, UV water treatment, architectural lighting, stage lighting, medical illumination, microscopes, projectors and displays, any combination of these, and the like.

In an example, the present invention provides a plasma lamp apparatus. The apparatus has a shaped (e.g., cylindrical, cubic, or polyhedron, etc.) housing member (cavity) having an interior region, and an exterior region coupled to a base region and top region. The apparatus has a support member configured within the interior region of the cylindrical housing member and in parallel alignment with the exterior region. The support member has a first end and a second end, which is configured to the base region. In an example, the support member or element is also known as the output coupling element. The apparatus has a bulb configured on the first end of the support member. In an example, the bulb comprises a fill material. The apparatus has a feed structure, also known as the input coupling element, having a first end and a second end. The first end is substantially perpendicular to the support structure, and the second end is configured in substantial parallel alignment to the support member. The apparatus has an RF source coupled to the feed structure and configured to cause electromagnetic coupling between the feed structure and the support member to output electromagnetic radiation.

Depending upon the embodiment, the other techniques described below can also include the feed structure, which is coupled horizontally or in a non-vertical manner relative to a direction of the bulb structure.

In yet another embodiment, the bulb/output coupling-element assembly within the plasma electrodeless lamp comprises a single or multi-sectioned body. In a first section, a first coupling-element comprising a solid conductor is closely received but not wholly enclosed by a dielectric body. A portion of the first section may be conductively coated. In a second section, a gas-filled vessel (bulb) is closely received by a dielectric body; the gas-filled vessel may or may not be wholly enclosed by the dielectric body. In a third section, a second coupling-element comprising a solid conductor is closely received but not wholly enclosed by a dielectric body. A portion of the third section may be conductively coated. No DC conduction path exists between the first and third sections; electromagnetic energy is capacitively or inductively or a combination of capacitively and inductively coupled between them through the second section.

In yet another aspect, the first and second coupling-elements comprise dielectric material coated with a conductive veneer, and the gas-filled vessel is partially but closely received by the center dielectric portion of the first and second coupling-element. No DC conduction path exists between the first and second coupling-elements; electromagnetic energy is capacitively or inductively or a combination of capacitively and inductively coupled between them through gas-filled vessel.

In a specific embodiment, the present invention provides an electrodeless plasma lamp. The lamp has a conductive housing having a spatial volume defined within the conductive housing. In a specific embodiment, the spatial volume having an inner region and an outer region within the conductive housing. The lamp has a support body having an outer surface region disposed within or partially within the inner region of the spatial volume of the conductive housing and a conductive material overlying the outer surface region of the support body. The lamp has a gas-filled vessel having a transparent or translucent body having an inner surface and an outer surface and a cavity formed within the inner surface. In a specific embodiment, the lamp can also include both a transparent and translucent portion. The gas-filled vessel comprises a first end region and a second end region and a length defined between the first end region and the second end region. A first coupling-element (bulb/output coupling-element) is coupled to the first end region of the gas-filled vessel. The first coupling-element is electrically coupled to the conductive material. A second coupling-element is coupled to the second end region of the gas filled vessel. An RF source coupling-element is spatially disposed within the outer region of the conductive housing and within a predetermined distance from the first coupling-element. The lamp has a gap (e.g., air gap) provided between the RF source coupling-element and the first coupling-element. The gap provided by the predetermined distance according to a specific embodiment. The lamp has an RF source comprising an output and optionally an input. The output of the RF source is coupled to the first coupling-element through the gap and the RF source coupling-element.

In an alternative specific embodiment, the present invention provides an alternative electrodeless plasma lamp. The lamp has a conductive housing having a spatial volume defined within the conductive housing. The spatial volume has an inner region and an outer region within the conductive housing. In a specific embodiment, the lamp has a support body having an outer surface region disposed within or partially within the inner region of the spatial volume of the conductive housing and a conductive material overlying the outer surface region of the support body. The lamp has a gas-filled vessel having a transparent or translucent body having an inner surface and an outer surface and a cavity formed within the inner surface. The gas filled vessel comprises a first end region and a second end region and a length defined between the first end region and the second end region. In a specific embodiment, the lamp has a first coupling-element (bulb/output coupling-element) coupled to the first end region of the gas-filled vessel. The first coupling-element is electrically coupled to the conductive housing. The lamp has an RF source coupling-element spatially disposed within the outer region of the conductive housing and within a predetermined distance from the first coupling-element. In a specific embodiment, the lamp has a gap provided between the RF source coupling-element and the first coupling-element. The gap is formed by the predetermined distance. In a specific embodiment, the lamp has an RF source comprising an output and optionally an input. The output of the RF source is coupled to the first coupling-element through the gap and the RF source coupling-element.

In yet an alternative specific embodiment, the present invention provides an electrodeless plasma lamp. The lamp has a conductive housing having a spatial volume defined within the conductive housing. The spatial volume having an inner region and an outer region. The lamp has a metal support body having an outer surface region disposed within or partially within the inner region of the spatial volume of the conductive housing. The lamp has a gas-filled vessel having a transparent or translucent body having an inner surface and an outer surface and a cavity formed within the inner surface. The gas-filled vessel comprises a first end region and a second end region and a length defined between the first end region and the second end region. The lamp has a first coupling-element coupled to the first end region of the gas-filled vessel. In a specific embodiment, the first coupling-element is electrically coupled to the conductive housing. The lamp also has a second coupling-element coupled to the second end region of the gas-filled vessel. An RF source coupling-element is spatially disposed within the outer region of the conductive housing and within a predetermined distance from the first coupling element. A gap is provided between the RF source coupling-element and the first coupling-element. The lamp has an RF source comprising an output, which is coupled to the first coupling-element through the gap and the RF source coupling-element.

Still further, the present invention provides a method of operating an electrodeless plasma lamp device. The method includes providing a plasma lamp, which can be any of the ones described herein. The method includes transferring RF energy from the RF source to the input coupling-element (RF source coupling-element), which is coupled to a gas filled vessel through a bulb/output coupling-element (first coupling-element) and an air gap. In a preferred embodiment, the RF energy has a frequency ranging from about 100 MHz to about 20 GHz, but can be others. The method includes illuminating electromagnetic energy substantially from the length of the gas-filled vessel from discharge of the gas-filled vessel. Optionally, the method includes transferring thermal energy from the gas-filled vessel through a conductive material of the first coupling element. In a preferred embodiment, the conductive material can be characterized as a thermal conductor and an electrical conductor.

Moreover, the present invention provides a method of operating an electrodeless plasma lamp device. The method includes providing a plasma lamp device, which can be any of the ones described herein. The method includes adjusting a predetermined distance between an RF source coupling-element and a first coupling-element coupled to a gas-filled vessel from a first distance to a second distance to change the first gap to a second gap, which is different from the first gap. In a preferred embodiment, the predetermined distance is an air gap or other non-solid region. Of course, there can be other variations, modifications, and alternatives.

Benefits are achieved over pre-existing techniques using the present invention. In a specific embodiment, the present invention provides a method and device having configurations of input, output, and feedback coupling-elements that provide for electromagnetic coupling to the bulb whose power transfer and frequency resonance characteristics that are largely independent of the conventional dielectric resonator. In a preferred embodiment, the present invention provides a method and configurations with an arrangement that provides for improved manufacturability as well as design flexibility. Other embodiments may include integrated assemblies of the output coupling element and bulb that function in a complementary manner with the present coupling element configurations and related methods. Still further, the present method and device provide for improved heat transfer characteristics, as well as further simplifying manufacturing. In a specific embodiment, the present method and resulting structure are relatively simple and cost effective to manufacture for commercial applications. Depending upon the embodiment, one or more of these benefits may be achieved. These and other benefits may be described throughout the present specification and more particularly below.

The present invention achieves these benefits and others in the context of known process technology. However, a further understanding of the nature and advantages of the present invention may be realized by reference to the latter portions of the specification and attached drawings.

BRIEF DESCRIPTION OF THE DRAWINGS

A more complete understanding of the present invention and its advantages will be gained from a consideration of the following description of preferred embodiments, read in conjunction with the accompanying drawings provided herein. In the figures and description, numerals indicate various features of the invention, and like numerals referring to like features throughout both the drawings and the description.

FIG. 4 is a table illustrating data including lumens for various lamp apparatus according to examples of the present invention.

DETAILED DESCRIPTION OF THE INVENTION

Figure 1:
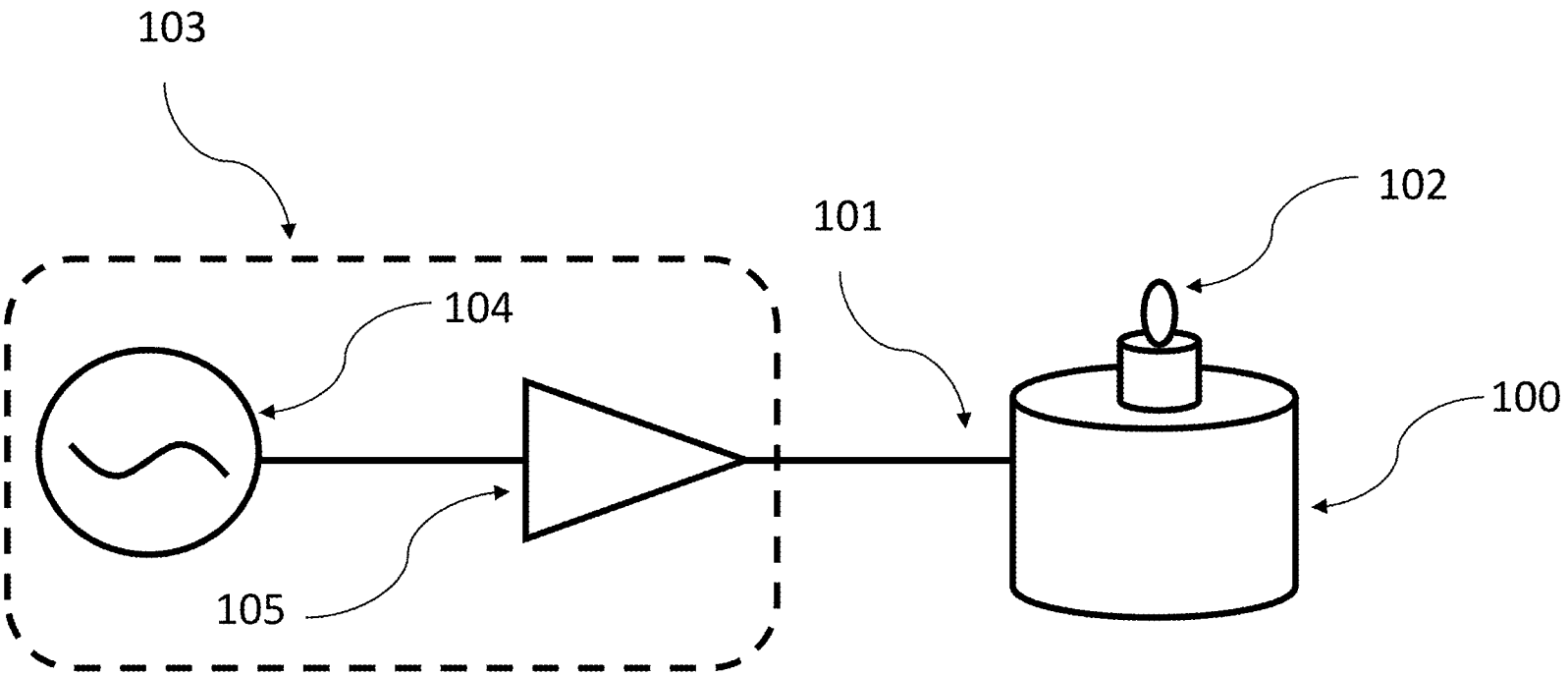
FIG. 1 shows a general diagram of the plasma lamp apparatus according to an embodiment of the present invention.

According to the present invention, techniques directed to devices and methods for generating light with plasma lamps are provided. More particularly, the present invention provides plasma lamps driven by a radio-frequency source without the use of electrodes inside a gas-filled vessel (bulb) and related methods. Merely by way of example, such plasma lamps can be applied to applications such as stadiums, security, parking lots, military and defense, streets, large and small buildings, bridges, warehouses, agriculture, uv water treatment, architectural lighting, stage lighting, medical illumination, microscopes, projectors and displays, any combination of these, and the like.

The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the Claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object. Additionally, the terms "first" and "second" or other like descriptors do not necessarily imply an order, but should be interpreted using ordinary meaning.

Design of some conventional electrodeless plasma lamps uses a shaped housing member that feature an RF input that couples the RF energy to the housing member through a hole at the bottom of the housing member. This adds length to the overall height of the housing member and often makes it difficult for the lamp to be integrated into certain light fixtures. Embodiments of the present invention introduced here allow the RF feed structure (or input coupling element) to enter the housing member from the side, reducing the overall height of the housing member.

In some embodiments, the RF feed structure enters anywhere on the side of the housing member in the horizontal direction (in other words, input coupling element enters the housing member perpendicular to the output coupling element. In prior implementations, the input coupling element entered the housing member parallel to the output coupling element). The feed structure is then bent by a certain amount towards the vertical direction so that it is parallel or near-parallel to the output coupling element where it is then connected to the top or bottom of the housing member. In a specific embodiment, the outer conductor of the feed structure of the feed structure remains on the feed structure through the entire bend of the feed structure. Only when the feed structure in completely parallel or near-parallel does the shielding no longer needs to be attached and the inner conductor exposed. This configuration allows coupling of the RF energy from the input coupling element to the proper mode in the housing member.

This new input method offers many advantages over conventional methods. One or more of the following advantages can be realized depending on the specific embodiment. For example, the side feeding method allows the housing member to be shortened considerably. The lamp will be able to fit in more existing fixtures. The flat bottom of the housing member can now be more easily integrated with heat sinks for cooling. This configuration also can simplify mechanical design for fixtures.

FIG. 1 shows a general diagram of the plasma lamp apparatus according to an embodiment of the present invention. A cylindrical or shaped housing member 100 holds the bulb 102 that emits light when illuminated with RF electromagnetic radiation. RF radiation is supplied to the housing member by the feed structure 101 that enters the housing member from the side. An RF source, represented by 103 that comprises of an RF generator 104 and an RF amplifier 105, supplies the feed structure with RF radiation.

Figure 2:
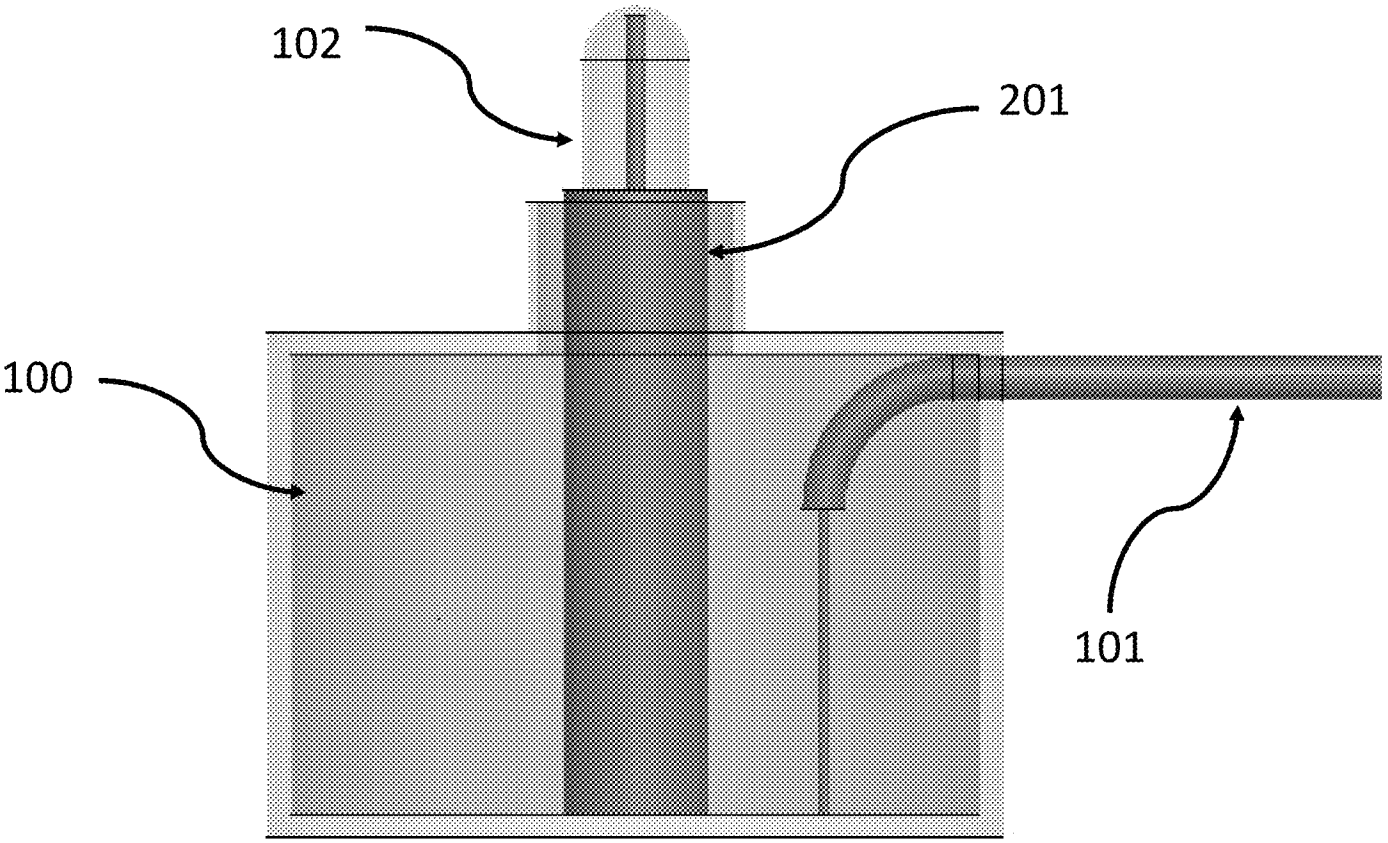
FIG. 2 shows a detailed housing member according to an embodiment of the present invention.

FIG. 2 shows a detailed housing member according to an embodiment of the present invention. The feed structure 101 enters the housing member from the side perpendicular to the support member 201. The feed structure is bent inside the housing member so that a portion of the feed structure is parallel or near-parallel to the support member. The support member holds the bulb structure 102 and acts as a coupling element to supply RF radiation to the bulb.

Figure 3:
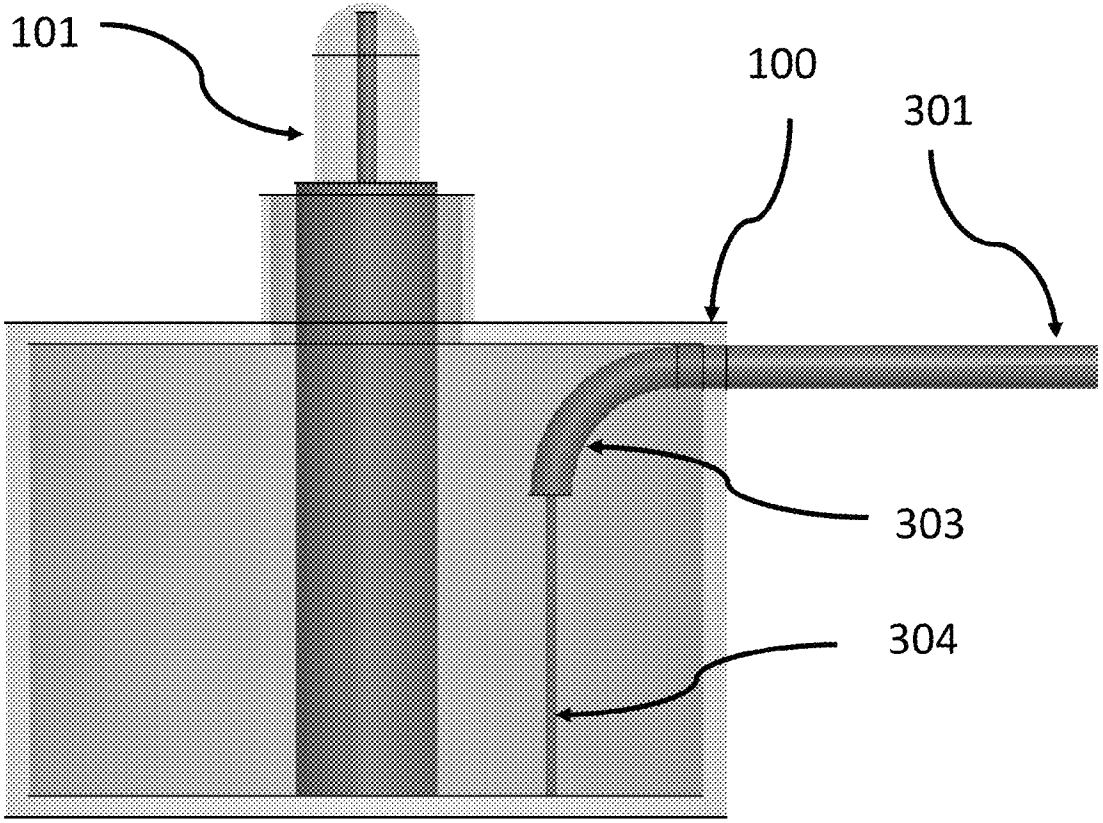
FIG. 3 shows a detailed housing member with support and feed structure according to an embodiment of the present invention.

FIG. 3 shows a detailed housing member with support and feed structure according to an embodiment of the present invention. The input position of the feed structure, represented by 301, can enter the housing member 100 anywhere along the side. In this embodiment, the feed structure enters the side at the top of the housing member. The feed structure comprises of an outer conductor 303 and inner conductor 304. In an embodiment, the feed structure includes both the inner and outer conductors when it enters the housing member. Both the inner and outer conductors are then bent to a parallel or near-parallel configuration with the support member 201. After the bend, the inner conductor is exposed by removing the outer conductor for a portion of the length to allow RF coupling to the support member.

In an example, the apparatus has an operating frequency of 433-435 MHz, or from 1 MHz to 10 GHz, among others. In an example, the RF power will be between 300-350 W for 50,000 lumens. Out of the wall, AC power are around 400-450 W in some examples, although there can be variations. In an example, the bulb material will be a fill of metal halides, mercury, argon, and other rare-earth metals. In an example, ignition of the bulb is a computer controlled ramp up that manages the power and frequency during the phases of the plasma lamp. Phases include ignition, transition, power ramp up, and steady state operation. In an example, the side fed resonator is a mechanical design to allow the lamp to be accommodated by a larger number of fixtures, which cannot be configured with a bottom fed resonator. It provides flexibility for scaling the lamp for different bulbs and powers without the need to have a completely different resonator structure (housing member). Of course, there can be variations. In an example, the present apparatus achieves about 40,000 lumens or 48,000 lumens and greater, as illustrated in FIG. 4.

FIG. 4 is a table illustrating data including lumens for various lamp apparatus according to embodiments of the present invention.

In an example, energy from the RF source is directed to an impedance matching network that enables the effective transfer of energy from RF source to resonating structure. An example of such impedance matching network is an E-field or H-field coupling element, but can be others. Another impedance matching network, in turn, enables efficient energy transfer from resonator to gas-filled vessel according to an embodiment of the present invention. An example of the impedance matching network is an E-field or H-field coupling element Of course, there can be other variations, modifications, and alternatives.

In a specific embodiment, the gas-filled vessel is made of a suitable material such as quartz or other transparent or translucent material. The gas-filled vessel is filled with an inert gas such as Argon and a fluorophor such as Mercury, Sodium, Dysprosium, Sulfur or a metal halide salt such as Indium Bromide, Scandium Bromide, or Cesium Iodide (or it can simultaneously contain multiple fluorophors). Mercury, Thallium Iodide, and Indium Bromide according to a specific embodiment. The gas-filled vessel can also includes a metal halide, or other metal pieces that will discharge electromagnetic radiation according to a specific embodiment. Of course, there can be other variations, modifications, and alternatives.

In a specific embodiment, a capacitive coupling structure is used to deliver RF energy to the gas fill within the bulb. As is well known, a capacitive coupler typically comprises two electrodes of finite extent enclosing a volume and couples energy primarily using at least Electric fields (E-fields). As can be appreciated by one of ordinary skill in the art, the impedance matching networks and the resonating structure can be interpreted as equivalent-circuit models of the distributed electromagnetic coupling between the RF source and the capacitive coupling structure. The use of impedance matching networks also allows the source to have an impedance other than 50 ohm; this may provide an advantage with respect to RF source performance in the form of reduced heating or power consumption from the RF source. Lowering power consumption and losses from the RF source would enable a greater efficiency for the lamp as a whole. As can also be appreciated by one of ordinary skill in the art, the impedance matching networks are not necessarily identical.

In an example, a cylindrical lamp body is provided, but rectangular or other shapes may be used. This conductivity may be achieved through the application of a conductive veneer, or through the choice of a conductive material. An example embodiment of conductive veneer is silver paint or alternatively the lamp body can be made from sheet of electrically conductive material such as aluminum. An integrated bulb/output coupling-element assembly is closely received by the lamp body through an opening. The bulb/output coupling-element assembly contains the bulb, which is a gas-filled vessel that ultimately produces the luminous output.

One aspect of the invention is that the bottom of the assembly, output coupling-element, is grounded to the body and its conductive surface at plane. The luminous output from the bulb is collected and directed by an external reflector, which is either electrically conductive or if it is made from a dielectric material has an electrically conductive backing, and which is attached to and in electrical contact with the body. Another aspect of the invention is that the top of the assembly, top coupling-element, is grounded to the body at plane via the ground strap and the reflector. Alternatively, the reflector may not exist, and the ground strap makes direct electrical contact with the body. Reflector is depicted as parabolic in shape with bulb positioned near its focus. Those of ordinary skill in the art will recognize that a wide variety of possible reflector shapes can be designed to satisfy beam-direction requirements. In a specific embodiment, the shapes can be conical, convex, concave, trapezoidal, pyramidal, or any combination of these, and the like. The shorter feedback E-field coupling-element couples a small amount of RF energy from the bulb/output coupling-element assembly and provides feedback to the RF amplifier input of RF amplifier. Feedback coupling-element is closely received by the lamp body through opening, and as such is not in direct DC electrical contact with the conductive surface of the lamp body. The input coupling-element is conductively connected with RF amplifier output. Input coupling-element is closely received by the lamp body through opening, and as such is not in direct DC electrical contact with the conductive surface of the lamp body. However, it is another key aspect of the invention that the top of the input coupling-element is grounded to the body and its conductive surface at plane.

In an example, RF power is primarily inductively coupled strongly from the input coupling-element to the bulb/output coupling-element assembly through physical proximity, their relative lengths, and the relative arrangement of their ground planes. Surface of bulb/output coupling-element assembly is covered with an electrically conductive veneer or an electrically conductive material and is connected to the body and its conductive surface. The other surfaces of the bulb/output coupling-element assembly including surfaces and are not covered with a conductive layer. In addition surface is optically transparent or translucent. The coupling between input coupling-element and output coupling-element and lamp assembly is found through electromagnetic simulation, and through direct measurement, to be highly frequency selective and to be primarily inductive. This frequency selectivity provides for a resonant oscillator in the circuit comprising the input coupling-element, the bulb/output coupling-element assembly, the feedback coupling-element, and the amplifier.

A significant advantage of the invention is that the resonant frequency is strongly dependent on the relative lengths of the input and output coupling-elements. This permits the use of a compact lamp body whose natural resonant frequency may be much higher than the actual frequency of operation. In one example embodiment, the bottom of the lamp body may consist of a hollow aluminum cylinder with a 1.5" diameter, and a height of 0.75". The fundamental resonant frequency of such an air cavity resonator is approximately 4 GHz but by using the design described above for the input coupling-element and the output coupling-element and by adjusting the length of the output coupling-element the overall resonant frequency of the lamp assembly can be reduced to 900 MHz or no greater than about 900 MHz in a specific embodiment. Another significant advantage of the invention is that the RF power coupled to the bulb is strongly dependent on the physical separation between the input coupling-element and the output coupling-element within the bulb/output coupling-element assembly. This permits fine-tuning, at assembly time, of the brightness output of a lamp which is comprised of components with relaxed dimensional tolerances. Another significant advantage of the invention is that the input-coupling-element and the bulb/output coupling-element assembly are respectively grounded at planes, which are coincident with the outer surface of the body. This eliminates the need to fine-tune their depth of insertion into the lamp body—as well as any sensitivity of the RF coupling between them to that depth—simplifying lamp manufacture, as well as improving consistency in lamp brightness yield.

In an example, RF amplifier output is conductively connected with input coupling-element, which delivers RF power to the lamp/output coupling-element assembly. The resonant characteristics of the coupling between the input coupling-element and the output coupling-element in the bulb/output coupling-element assembly are frequency-matched to the RF source to optimize RF power transfer. Of course, there can be other variations, modifications, and alternatives.

In an example, a top coupling-element in the bulb assembly is directly connected to the lamp body using ground straps.

In an example, the lamp/output coupling element assembly consists of a solid metal (metal post) recessed at the top to receive the gas-filled vessel. The other end of the coupling-element is grounded to lamp body at surface. The top portion of the metal post is surrounded by metal ring. A thin layer of dielectric material or refractory metal such as molybdenum can be used as interface between the bulb and the metal post. Alternatively the top part of the metal post or all of the metal post can be made from a refractory metal with its outer surface covered with a layer of metal with high electrical conductivity such as silver or copper. The metal post can also be hollow inside.

In an example, a lamp assembly comprises a lower section, a mid-section, and upper section. Alternatively, these sections may not be physically separate. The lower section is bored to closely receive output coupling-element, which is a solid conductor. Coupling-element protrudes from the lower section. It is a key aspect of this invention that coupling-element makes ground contact at plane with the lamp body. The mid-section is hollowed to closely receive the bulb, which is the gas-filled vessel that ultimately produces the lamp's luminous output. The gas-filled vessel contains an inert gas such as Argon and a fluorophor such as Mercury, Sodium, Sulfur or a metal halide salt such as Indium Bromide or Cesium Iodide (or it can simultaneously contain multiple fluorophors). Alternatively, the mid-section is hollowed, with the resulting cavity forming the volume of the bulb, making the two an integrated unit. The mid-section can be attached to the lower section and upper section using high temperature adhesive. The upper section is bored to closely receive top electrode, which is a solid conductor. Top electrode protrudes from upper section. It is a key aspect of this invention that the top coupling-element makes ground contact at plane with the lamp body. This is through the ground strap and the reflector body or ground strap. Overall, RF energy is coupled capacitively, or inductively, or a combination of inductively and capacitively, by the output coupling-element and top coupling-element to the bulb, which is made from quartz, translucent alumina, or other similar material, ionizing the inert gas and vaporizing the fluorophor resulting in intense light emitted from the lamp.

In an example, sections can all be made from the same material or from different materials. Section has to be transparent to visible light and have a high melting point such as quartz or translucent alumina. Sections can be made from transparent (quartz or translucent alumina) or opaque materials (alumina) but they have to have low loss at RF frequencies. In the case that the same material is used for all three sections the assembly can be made from a single piece of material such as a hollow tube of quartz or translucent alumina. The upper section may be coated with a conductive veneer whose purpose is to shield electromagnetic radiation from the top-electrode. The lower section may be partially coated with a conductive veneer whose purpose is to shield electromagnetic radiation from the output coupling-element. The partial coating would extend to the portion of the lower section that protrudes from the lamp body and does not overlap with input coupling-element. An example embodiment of conductive veneers is silver paint. Alternatively, instead of conductive veneers portion of the lower section can be covered by a metal ring as part of the extension of lamp body. The outer surface of the mid section is not coated.

In an example, any of the above embodiments can be configured with a feed source comprising a tube or other solid member as a coupling element from a side region of a housing. The tube is then configured in a downward direction, and coupled to a base region. Further details of elements of the present lamp device can be found in U.S. patent application Ser. No. 12/484,933, filed Jun. 15, 2009, now U.S. Pat. No. 7,830,092, U.S. patent application Ser. No. 12/624,384, filed Nov. 23, 2009, now U.S. Pat. No. 8,179,047, U.S. patent application Ser. No. 12/720,603, filed Mar. 9, 2010, now U.S. Pat. No. 8,282,435, all of which are commonly assigned and incorporated by reference herein for all purposes.

While the above is a full description of the specific embodiments, various modifications, alternative constructions and equivalents may be used. Therefore, the above description and illustrations should not be taken as limiting the scope of the present invention.

What is claimed is:

1. A plasma lamp apparatus comprising:

a shaped housing member having an interior region, and an exterior region coupled to a base region and a top region;

a support member configured within the interior region of the cylindrical housing member and in parallel alignment with the exterior region, the support member having a first end and a second end, the second end being configured to the base region;

a bulb configured on the first end of the support member, the bulb comprising a fill material;

a feed structure, having a first end and a second end, the first end being substantially perpendicular to the support structure, and the second end being configured in substantially parallel alignment to the support member; and an RF source coupled to the feed structure and configured to cause electromagnetic coupling between the feed structure and the support member to output electromagnetic radiation.

2. The apparatus of claim 1 wherein the first end of the feed structure is substantially perpendicular to the support member.

3. The apparatus of claim 1 wherein the second end of the feed structure is configured to a portion of the base or the top region.

4. The apparatus of claim 1 wherein the substantially parallel alignment ranges from about 0 to less than 90 degrees from a reference region.

5. The apparatus of claim 1 further comprising a top plate region configured to enclose the interior region of the housing member, the top plate region comprising an opening to allow a portion of the first end of the support structure and the bulb to be exposed outside of the housing member such that the bulb has an exposed region of greater than about 270 degrees.

6. The apparatus of claim 1 wherein feed structure is configured to an adjustment device spatially disposed on a top plate region of the housing member.

7. The apparatus of claim 1 wherein the housing member comprises a metallic material, an electrically conductive material, or an electrically conductive coating.

8. The apparatus of claim 1 wherein the support member comprises a metallic material, an electrically conductive material, or an electrically conductive coating.

9. The apparatus of claim 1 wherein the interior region of the housing member comprise air.

10. The apparatus of claim 1 wherein the interior region of the housing member comprise air and a dielectric material having a dielectric constant greater than 1 and less than 100 substantially filling the interior region of the cylindrical housing member.

11. The apparatus of claim 1 wherein the interior region of the housing member comprise air and a dielectric material having a dielectric constant greater than 1 and less than 100 substantially filling the interior region of the cylindrical housing member.

12. The apparatus of claim 1 wherein the housing member comprises a constant diameter.

13. The apparatus of claim 1 wherein the housing member comprises a varying diameter.

14. The apparatus of claim 1 wherein the support member comprises a constant width.

15. The apparatus of claim 1 wherein the support member comprises a varying diameter or width.

16. The apparatus of claim 1 wherein feed structure is configured to an adjustment device spatially disposed on a portion of the base region.

17. The apparatus of claim 1 wherein the bulb is substantially free from any internal electrode members, wherein the bulb is configured to excite the fill material and cause formation of a plasma discharge to provide output of the electromagnetic radiation.

18. The apparatus of claim 1 wherein the RF source generates an RF signal having a frequency from about 1 MHz to 10 GHz, and wherein the RF source is characterized by a power of 50 Watt to 5,000 Watts.

19. The apparatus of claim 1 wherein the plasma lamp apparatus is configured with a plurality of other plasma lamp apparatuses to form an array of high intensity plasma discharge sources.

20. The apparatus of claim 1 wherein the electromagnetic radiation is characterized by 10,000 lumens to about 100,000 lumens.

21. The apparatus of claim 1 wherein the RF source comprises an oscillator coupled to an amplifier device.

22. The apparatus of claim 1 wherein the housing member has a height of six inches or less.

23. The apparatus of claim 1 wherein the base region having a substantially flat surface region.

24. The apparatus of claim 1 wherein the feed structure comprises a single bend having an angle ranging from about 45 degrees to about 135 degrees.

25. The apparatus of claim 1 wherein the feed structure comprises of a coaxial structure that has an inner and an outer conductor.

26. The apparatus of claim 1 wherein the feed structure comprises of a structure that has an inner and an outer conductor.

27. The apparatus of claim 26 wherein the feed structure comprises of both the inner and outer conductor from the entry to the housing structure through a single bend having an angle ranging from about 45 degrees to about 135 degrees.

28. The apparatus of claim 26 wherein the feed structure comprises of only the inner conductor after a single bend to where it is configured to the top or bottom portion, wherein the single bend has an angle ranging from about 45 degrees to about 135 degrees.

29. The apparatus of claim 1 wherein the feed structure enters the housing region horizontally along the side of the housing.

* * * * *